US007014577B2

(12) United States Patent
Van Asselt

(10) Patent No.: US 7,014,577 B2
(45) Date of Patent: Mar. 21, 2006

(54) BALL GAME APPARATUS

(76) Inventor: Jan Abraham Van Asselt, 10 Stangrave Hall, Bletchingley Road, Godstone, Surrey RH9 8NB (GB)

( * ) Notice: Subject to any disclaimer, the term of this patent is extended or adjusted under 35 U.S.C. 154(b) by 0 days.

(21) Appl. No.: 10/416,818

(22) PCT Filed: Nov. 6, 2001

(86) PCT No.: PCT/GB01/04919

§ 371 (c)(1),
(2), (4) Date: Dec. 3, 2003

(87) PCT Pub. No.: WO02/41955

PCT Pub. Date: May 30, 2002

(65) Prior Publication Data

US 2004/0072632 A1 Apr. 15, 2004

(30) Foreign Application Priority Data

Nov. 22, 2000 (GB) ..... 0028454

(51) Int. Cl.
*A63B 69/00* (2006.01)

(52) U.S. Cl. ..... 473/423; 473/422; 473/428

(58) Field of Classification Search ..... 473/422, 473/431, 138–149

See application file for complete search history.

(56) References Cited

U.S. PATENT DOCUMENTS

| | | | | |
|---|---|---|---|---|
| 3,630,521 A | | 12/1971 | Lingbeek et al. | 273/26 |
| 4,138,107 A | | 2/1979 | Janis | 273/29 |
| 6,821,216 B1 | * | 11/2004 | Van Asselt | 473/422 |

FOREIGN PATENT DOCUMENTS

| | | | |
|---|---|---|---|
| DE | 8804865 | * | 7/1988 |
| GB | 201645 | | 8/1923 |
| GB | 2332861 | | 7/1999 |
| GB | 2350568 | | 6/2000 |

* cited by examiner

*Primary Examiner*—Mitra Aryanpour
(74) *Attorney, Agent, or Firm*—Blank Rome LLP

(57) ABSTRACT

Apparatus for improving the skills of a sports person comprises two diverging guidelines at least one of which is resilient and tensioned. A reciprocating line extends between and is connected to each guideline whose length is equal to or greater than the minimum spacing of the guidelines and less than the maximum spacing of the guidelines. A ball is connected to and generally coaxial with the reciprocating line, the arrangement being such that when the ball is struck the reciprocating line is moved by its connection with the ball along the guidelines in the direction of their divergence until restrained from further movement by forces imposed on the line caused by the increased spacing between the guidelines and stretching of the resilient guideline(s). The ball and reciprocating line are returned to their starting positions (or positions close thereto) along the guidelines in the direction of their convergence through reactive forces generated between the reciprocating line and the resilient guideline(s).

17 Claims, 4 Drawing Sheets

BALL GAME APPARATUS

This invention relates to practice apparatus for golf, baseball, tennis, cricket or similar ball games which involve striking and/or lofting a ball or like projectile (hereinafter referred to as a "ball"). More especially, but not exclusively, the invention relates to apparatus for improving the skills of participants in such sports.

In the field of competitive sport it is a well known adage that practice makes perfect. Thus, for example, golf players spend many hours improving, inter alia, their golf swing, baseball players their striking ability, and tennis players their stroke play.

In other ball game sports there are several inanimate trainers available, these including, inter alia, a ball attached by an elasticated strand, string or rope to some form of central support. Such trainers are unsatisfactory because the ball approaches the player at an unrealistic angle and speed. Furthermore, missing the ball results in the elasticated strand, string or rope becoming inconveniently entangled around the support.

Children also enjoy ball games, but unless they are coached, they have even less opportunity of improving their skills. Furthermore, few children have sufficient space and freedom from houses and cars to play ball games unrestrictedly.

U.S. Pat. No. 4,138,107 relates to a ball game practice device which comprises a ball connected to an elastic tether, the tether connected at either end to a carriage member which runs along a rigid rail.

U.S. Pat. No. 3,630,521 relates to a baseball batting practice device. Once again, a ball is connected to an elastic cord which is slidably linked to an upper and lower support wire. In both these disclosures, the elastic nature of the tether to the ball allows somewhat uncontrolled lateral movement of the ball once struck by the player.

UK-A-201645 relates to a golf practising device in which a ball is slidably anchored to a flight braking track anchored to the ground. The track comprises a pair of diverging non-stretchable wires to which the ball is slidably connected by means of a transverse cord whose length is less than the maximum divergence of the wires. The wires co-operate to bring the transverse cord to rest at a location distant from the position at which the ball by a person using the device.

All of these devices suffer from a number of disadvantages. A major disadvantage inherent in many such devices is that the ball is not returned automatically and safely to the striker of the ball. This desired objective is achieved by apparatus in accordance with the invention thereby enabling safe use of the apparatus even in restricted areas when normal practice of sports such as golf, baseball and tennis could not occur.

Accordingly, in one aspect the invention provides apparatus for improving the skills of a sports person which comprises two diverging guidelines at least one of which is resilient and tensioned, a reciprocating line extending between and connected to each guideline whose length is equal to or greater than the minimum spacing of the guidelines and less than the maximum spacing of the guidelines, and a ball connected to and generally coaxial with the reciprocating line, the arrangement being such that when the ball is struck the reciprocating line is moved by its connection with the ball along the guidelines in the direction of their divergence until restrained from further movement by forces imposed on the line caused by the increased spacing between the guidelines and stretching of the resilient guideline(s), the ball and reciprocating line being returned to their starting positions (or positions close thereto) along the guidelines in the direction of their convergence through reactive forces generated between the reciprocating line and the resilient guideline(s).

Preferably, both guidelines are resilient and tensioned. Alternatively, only one of the guidelines is resilient, the other guideline comprising, for example, a non-stretchable line, rail or the like.

The guidelines may be positioned side-by-side or one above the other. In the latter case where only one guideline is resilient, the resilient guideline is preferably positioned below the non-stretchable guideline.

The reciprocating line is preferably produced from a substantially non-elastic material. By the term "non elastic" is meant a material which has a very limited ability to stretch and change in length when struck.

In another aspect the invention provides apparatus for improving the skills of a sports person which comprises two inclined and diverging side-by-side resilient tensioned guidelines separated by a distance which increases as the height of the guidelines above ground level increases, a reciprocating line extending between and connected to each guideline whose length is equal to or greater than the minimum spacing of the guidelines and less than the maximum spacing of the guidelines, and a ball connected to and generally coaxial with the reciprocating line, the arrangement being such that when the ball is struck by a sports person the reciprocating line is moved by its connection with the ball upwardly along the resilient and diverging guidelines until restrained from further movement by the tensional forces imposed in the line as the spacing between the guidelines increase and stretching of the resilient guidelines, the ball being returned to its starting position (or to a position close thereto) by forces created as the resilient guidelines return to their relatively unstretched positions.

According to the invention in a further aspect, there is provided apparatus for improving the skills of a sports person which comprises two diverging guidelines separated at a distance which increases as the height above ground level of at least one of the guidelines increases, the guidelines being positioned one above the other and at least one of the guidelines being resilient and tensioned, a reciprocating line extending between and connected to each guideline whose length is equal to or greater than the minimum spacing of the guidelines and less than the maximum spacing of the guidelines, and a ball connected to and generally coaxial with the reciprocating line, the arrangement being such that when the ball is struck by a sports person at a striking position at or close to the position of minimum spacing of the guidelines, the reciprocating line is moved by its connection with the ball along the guidelines in the direction of their divergence until restrained from further movement, and is then returned to (or close to) the sports person along the guidelines in the direction of their convergence.

The guidelines may be separate one from the other; alternatively one guideline may comprise an extension of the other. For the purposes of this document, in this latter case the guidelines will be described as two guideline.

One end of each of the two guidelines may typically be secured to the ground through an anchor comprising, for example a stake or ground pin, or to a stable support. The other end of each of the two guidelines is typically attached to a stable support. The stable support may comprise a wall, frame or a pole.

The length of the guidelines and/or their angle of inclination above ground level may be varied in order to vary the type and/or difficulty of swing or stroke required, or the space available for training purposes.

The reciprocating line may be connected to the guidelines through a slide which may comprise a hinged clip, ring, rope slide or adjustable loop. For any such connection, it is important the connection is sufficiently robust to withstand the forces and wear and tear to which it will be subjected in use and that frictional forces are minimised.

In one embodiment one or both guidelines and/or the reciprocating lines are made of a low friction material. The guidelines and the reciprocating means may be made of the same material.

Tensioning means may be provided for varying the tension of each guideline. This may comprise a reel connected to the respective anchor or support.

Preferably, the connection between the ball and the reciprocating line is such as to enable the ball to rotate relative to the line. Thus, the ball may be provided with an axially extending bore through which the line may pass. In this arrangement, stops may be provided on the line to prevent unwanted sideways movement of the ball along the reciprocating line. Alternatively, no such stops may be provided, the ball being relatively free to travel sideways along the line. This sideways movement could be used to provide for the golfer an indication of any slice or hook imparted to the ball when struck.

In an alternative embodiment, each side of the ball may be attached by a clip, stitching or the like to a cord which is then connected through swivels to the reciprocating line. Other arrangements which achieve this objective could, of course, be adopted.

The ball may be, for example, a simulated golf ball, tennis ball or baseball.

The height and positioning of the lower ends of the guidelines may be adjustable.

As mentioned previously, an important feature of the skill improving apparatus of the present invention is that the ball is automatically returned to or close to its originally striking position. It is believed that this objective is achieved in the following way. When the ball is struck, the reciprocating line moves rapidly along the diverging guidelines. Because of this divergence, the or each resilient guideline is stretched by the reciprocating line and moved inwardly toward the other guideline until a point is reached where the tensional forces imposed by the guidelines on the reciprocating line cause the latter to come to rest. At this instant in time, the potential energy in the or each guideline generates a reactive kinetic force which causes the or each stretched guideline to seek to return to its original length and to propel the reciprocating line along the converging guidelines towards the initial striking position of the ball. The reactive force is generally determined by the formula:

$$mgh + \frac{1}{2}mv^2 + \frac{1}{2}C\Delta l^2 = \text{constant}$$

where mgh is potential energy, $\frac{1}{2}mv^2$ is kinetic energy and $\frac{1}{2}C\Delta l^2$ is elastic energy (other forces being disregarded).

The invention will now be described by way of example only with reference to the following diagrammatic drawing in which:—

In each of the Figures, the same reference numerals have been used for the same or similar integers.

Figure 1:
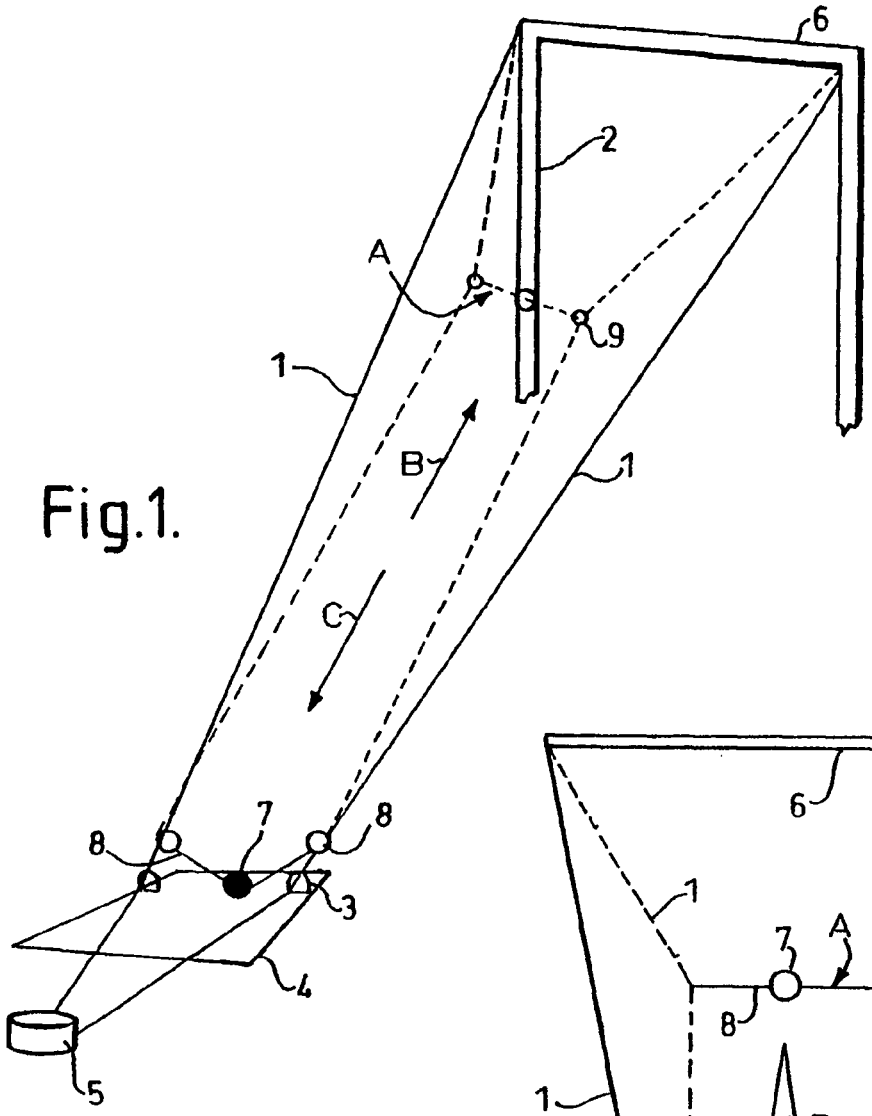
FIGS. 1 and 2 are respectively side perspective and plan views from above of apparatus in accordance with the invention.
Figure 2:
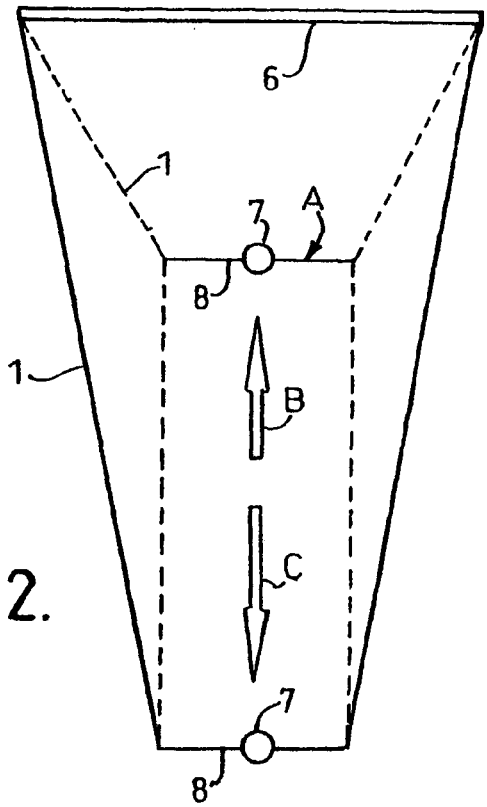

The apparatus shown in FIGS. 1 and 2 takes the form of a golf training aid. The apparatus comprises two tensioned guidelines 1, of plastics coated mono or multi filament resilient cord each of which is attached at one of its ends to raised supports 2 and at its other end through anchored guideline spacers 3 upstanding from a driving mat 4, and a grounded reeling mechanism 5. The guidelines are shown in full line in their unstretched positions in FIGS. 1 and 2, and in broken line in their stretched positions. In the FIGS. 1 and 2 embodiments, the guidelines are positioned side-by-side and the distance between the guidelines increases progressively as their height above ground level increases.

The supports 2 are held in position by ground engaging supports and the height of each support is adjustable. Tensional lines (not shown) are provided to retain the supports 2 upright and to resist the tensioning of the guidelines 1. A rigid cross-bar 6 extends between the supports 2 and determines the spacing therebetween. The cross-bar 6 may be positioned at a lower height relative to the supports 2 if required.

The illustrated arrangement of the supports 2 and cross-bar 6 is merely one example of a suitable supporting structure. Other structures can, of course, be employed. Thus, the structure may simply comprise a simple upstanding post which supports a cross-bar, or a wall to which the guidelines are attached.

A ball 7 is suspended by a reciprocating line 8 from the guidelines 1. Each end of the line 8 is linked to the guidelines by a ring 9 and the ball 7 is positioned generally coaxially with respect to the line, (that is to say, the ball axis is generally coextensive with the longitudinal axis of the line 8). Preferably, the line 8 is attached to the ball in such a way as to enable the ball to rotate relative to the line. Various examples of such connections are discussed below with reference to FIGS. 6 to 9. The dimensions and material of the rings 9 are selected to minimise frictional forces between the rings and the guidelines, and to withstand the forces and wear and tear to which the rings will be subjected to in use. Connections other than rings may be used for this purpose.

The reeling mechanism 5 tensions the guidelines in use and provides storage space for the guidelines 1 when not in use. As mentioned previously, the guidelines 1 may comprise separate lengths of resilient cord or may comprise discrete lengths of a single cord.

The spacers 3 also act as stops to bring the returning line and ball to a resting position.

The teeing-off position of the device is seen in FIG. 1. In this position, the ball 7 sits on the mat 4. The ball may be raised above the mat surface by a tee or the like. When the ball 7 is struck, it causes the reciprocating line 8 to travel along the guidelines 1 in the direction of their divergence 'B' until the force imposed on the line 8 by the now stretched resilient guidelines 1 is sufficient to bring the line 8 to a stop at position 'A' shown in FIGS. 1 and 2. As the guidelines 1 seek to return to their relatively unstretched positions, so a "whip-lash" type force is created which causes the line 8 and ball 7 to move downwardly along the guidelines 1 in their direction of convergence 'C' until the ball reaches (or comes close to reaching) its initial position on the mat 4. The minimal resistance between the rings 9 and the guidelines 1 assists this process.

Figure 3:
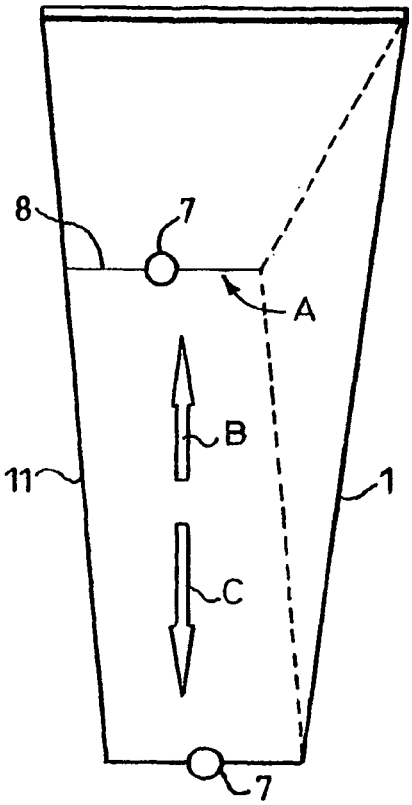
FIGS. 3 and 4 are plan views from above of alternative apparatus in accordance with the invention.
Figure 4:
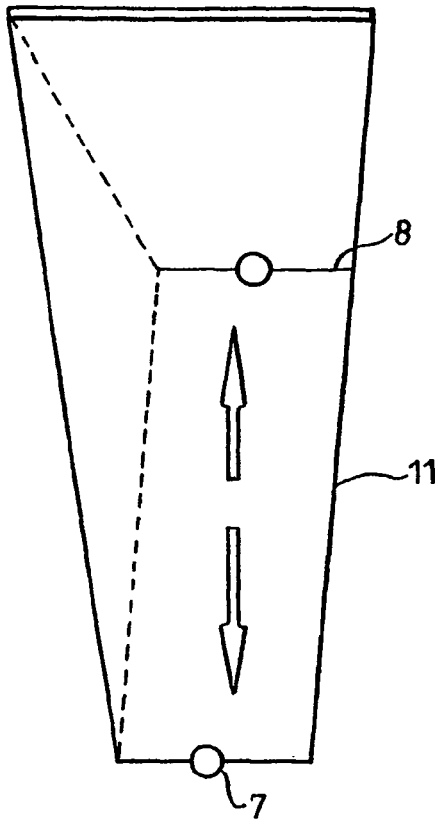

The devices illustrated in FIGS. 3 and 4 are similar to that illustrated in FIGS. 1 and 2 excepting that one of the resilient guidelines 1 is replaced by a relatively rigid non-resilient rail, rod, steel cable or cord 11. In FIG. 3 the left-hand guideline is relatively rigid and in FIG. 4 it is the right-hand guideline which is relatively rigid. The FIG. 3 embodiment is particularly advantageous for golfers who tend to impart slice and the FIG. 4 embodiment for golfers who tend to hook. In other respects, the FIGS. 3 and 4 embodiments are substantially the same as the FIGS. 1 and 2 embodiments.

Figure 5:
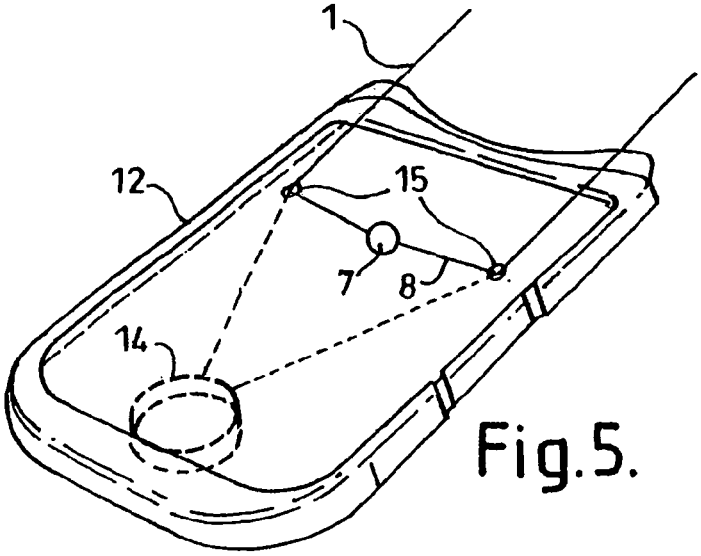
FIG. 5 is a perspective view of a detail of the apparatus illustrated in FIG. 1.

FIG. 5 illustrates a reeling mechanism for use with the golfing aid described above. The mechanism comprises a ground engaging box 12 which houses a tensioning reel 14. The guidelines 1 pass through apertures 15 formed in the box surface to the reel 14. As will be seen from FIG. 5, the upper surface of the box acts as a teeing surface for the ball 7.

As mentioned previously, it is preferable for the ball 7 to be connected to the reciprocating line 8 in such a way that the ball is able to rotate relative to the line thereby eliminating or substantially reducing any twisting of the line following striking of the ball.

Figure 6:
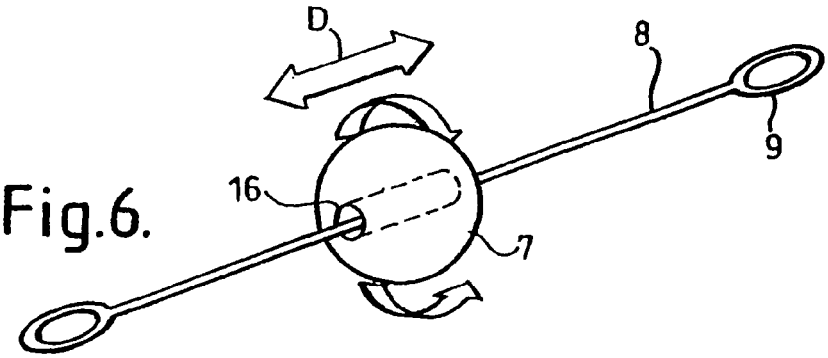
FIGS. 6 to 9 illustrate alternative fixings of a ball to a reciprocating line of apparatus in accordance with the invention.

In FIG. 6, the ball 7 is formed with an axially extending bore 16 through which the line 8 passes. The diameter of the bore is sufficient to minimise friction between the opposed surfaces of the bore and the line as the ball rotates. In this embodiment, the ball is free to move laterally along the line as indicated by arrows D. This enables a golfer to see if the ball has been hit to the left or right of centre.

Figure 7:
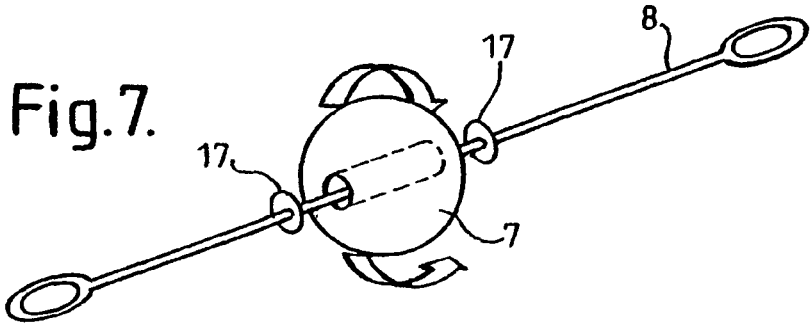

In FIG. 7, stops 17 are carried by the line 8 to inhibit lateral movement of the ball. These stops may be positioned close to the ball periphery or remote therefrom. The position of the stops 17 may be adjustable.

Figure 8:
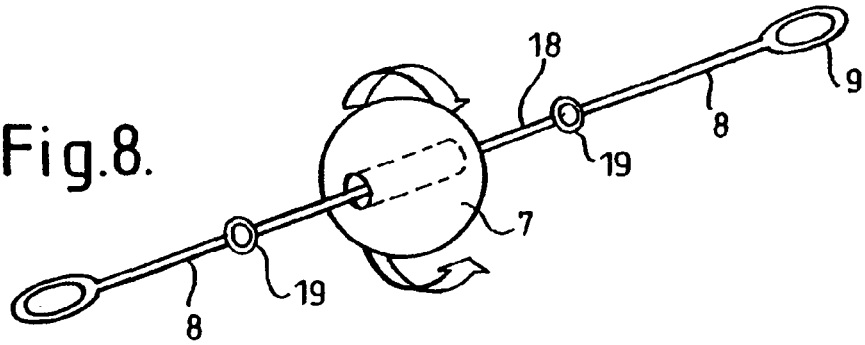

In the embodiment illustrated in FIG. 8, the line 8 includes a central relatively stiff section 18 about which the ball 7 can rotate. Thus, the line comprises two end lengths 8 connected together by the stiff section 18. The section 18 is connected to the lengths 8 by ringed ends 19 and may be produced from, for example, a metal.

Figure 9:
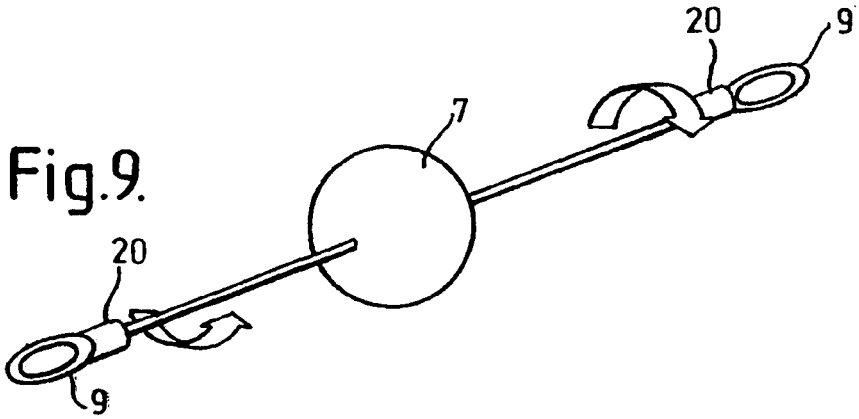

In FIG. 9 the ball 7 is fixed directly to the line-8, the latter being rotatably connected to the rings 9 by swivel connections 20.

Other ways of connecting the ball which enables ball rotation relative to the line 8 and/or the guidelines 1 may be provided.

Figure 10:
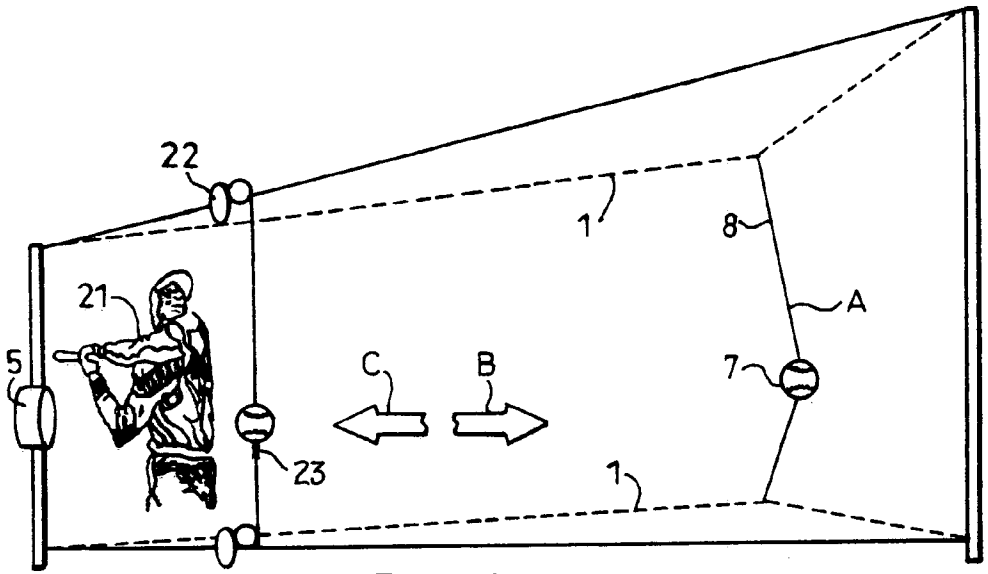
FIGS. 10 and 11 are side views of further alternative apparatus in accordance with the invention.
Figure 11:
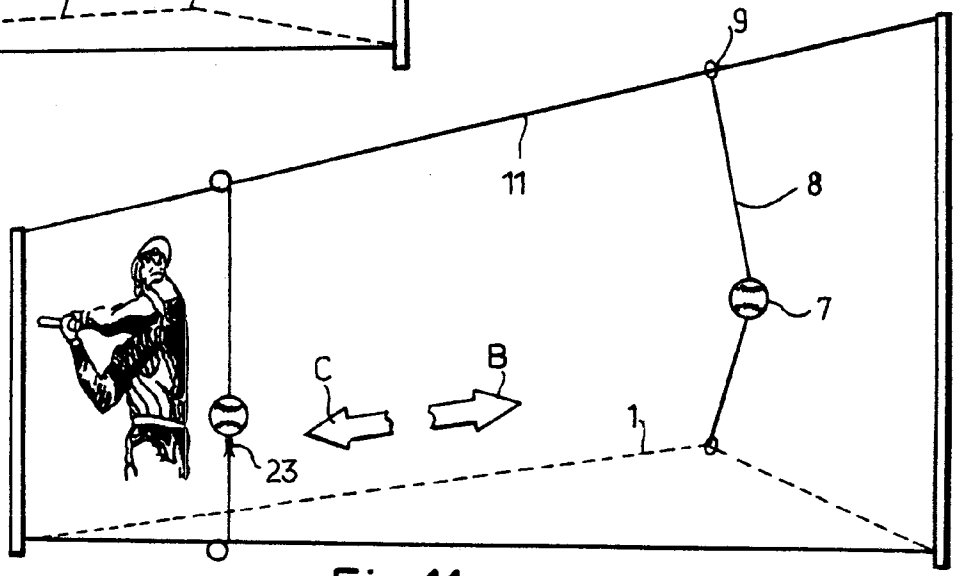

Turning now to FIGS. 10 and 11, the illustrated apparatus is particularly useful for improving the skills of, for example, baseball and tennis players. In these embodiments the guidelines 1 are positioned one above another instead of side by side as for the previously discussed embodiments. In FIG. 10, each guideline 1 is produced from a resilient material and in FIG. 11 the lower guideline 1 is resilient and the upper guideline 11 is relatively rigid. The lower guideline is preferably positioned above or slightly away from the ground to minimise frictional forces as the line 8 returns to the striker. The position of the ball 7 on the reciprocating line 8 can be changed by means of a slidable sleeve 23. Thus the height of the ball above ground level can readily be varied to accommodate differences in height of the user simply by sliding the sleeve upwardly or downwardly, the ball resting on the upper edge of the sleeve. Other slidably shaped devices can be used for this purpose. In other respects, the apparatus is similar to those described previously excepting that both ends of the guidelines 1 are supported above ground level by posts or the like. As shown in FIG. 10, the tensioning reel 5 may be carried by one of the supporting posts.

In use, a player 21 strikes the ball 7 to cause it to travel along the guidelines in their direction of divergence B. As the line 8 reaches position A it comes to rest and is returned to the player by the energy released as the stretched line or lines propel the ball along the guidelines in their direction of convergence C. The ball may be brought to rest by stops 22 before being struck one more time by the player. Alternatively, the stops may either be removed or so positioned that the player is obliged to strike the ball before it comes to rest.

It will be appreciated that the foregoing is merely exemplary of embodiments of the invention and that modifications can readily be made without departing from the scope of the invention as set out in the appended claims.

The invention claimed is:

1. Apparatus for improving the skills of a sports person which comprises two diverging guidelines at least one of which is resilient and tensioned, a reciprocating line extending between and connected to each guideline whose length is equal to or greater than the minimum spacing of the guidelines and less than the maximum spacing of the guidelines, and a ball connected to and generally coaxial with the reciprocating line, and tensioning means comprising a reel connected to an anchor or a support for varying the tension of each guideline, the arrangement being such that when the ball is struck the reciprocating line is moved by its connection with the ball along the guidelines in the direction of their divergence until restrained from further movement by forces imposed on the line caused by the increased spacing between the guidelines and stretching of the resilient guideline(s), the ball and reciprocating line being returned to their starting positions or positions close thereto along the guidelines in the direction of their convergence through reactive forces generated between the reciprocating line and the resilient guideline(s).

2. Apparatus as claimed in claim 1 wherein both guidelines are resilient and tensioned.

3. Apparatus as claimed in claim 2 wherein only one of the guidelines is resilient.

4. Apparatus as claimed in claim 1 wherein the guidelines are positioned side-by-side.

5. Apparatus as claimed in any claim 1 wherein one guideline is positioned at a height above ground level which is greater than that of the guideline.

6. Apparatus as claimed in claim 1 wherein the reciprocating line is produced from a substantially non-elastic material.

7. Apparatus for improving the skills of a sports person which comprises two inclined and diverging side-by-side resilient tensioned guidelines separated by a distance which increases as the height of the guidelines above ground level increases, a reciprocating line extending between and connected to each guideline whose length is equal to or greater than the minimum spacing of the guidelines and less than the maximum spacing of the guidelines, and a ball connected to and generally coaxial with the reciprocating line, and tensioning means comprising a reel connected to an anchor or a support for varying the tension of each guideline, the arrangement being such that when the ball is struck by a sports person the reciprocating line is moved by its connection with the ball upwardly along the resilient and diverging guidelines until restrained from further movement by the tensional forces imposed in the line as the spacing between the guidelines increase and stretching of the resilient guidelines, the ball being returned to its starting position or a position close thereto by forces created as the resilient guidelines return to their relatively original positions.

8. Apparatus for improving the skills of a sports person which comprises two diverging guidelines separated at a distance which increases as the height above ground level of at least one of the guidelines increases, the guidelines being positioned one above the other and at least one of the guidelines being resilient and tensioned, a reciprocating line extending between and connected to each guideline whose length is equal to or greater than the minimum spacing of the guidelines and less than the maximum spacing of the guidelines, a ball connected to and generally coaxial with the reciprocating line, and tensioning means comprising a reel connected to an anchor or a support for varying the tension of each guideline, the arrangement being such that when the ball is struck by a sports person at a striking position at or close to the position of minimum spacing of the guidelines, the reciprocating line is moved by its connection with the ball along the guidelines in the direction of their divergence until restrained from further movement, and is then returned to (or close to) the sports person along the guidelines in the direction of their convergence.

9. Apparatus as claimed in claim 1 wherein the guidelines are separate one from the other.

10. Apparatus as claimed in claim 1 wherein one guideline comprises an extension of the other.

11. Apparatus as claimed in claim 1 wherein one end of each of the two guidelines is secured to the ground through an anchor.

12. Apparatus as claimed in claim 11 wherein the other end of each of the two guidelines is attached to a stable support.

13. Apparatus as claimed in claim 1 wherein the reciprocating line is connected to the guidelines through a slide which comprises a hinged clip, ring, rope slide or adjustable loop.

14. Apparatus as claimed in claim 1 wherein the ball is provided with an axially extending bore through which the line may pass.

15. Apparatus as claimed in claim 14 wherein stops are provided on the line to prevent unwanted sideways movement of the ball along the reciprocating line.

16. Apparatus as claimed in claim 1 wherein each side of the ball is attached to a cord which is then connected through swivels to the reciprocating line.

17. Apparatus as claimed in claim 1 wherein the ball is a simulated golf ball, tennis ball or baseball.

* * * * *